US010571825B1

(12) United States Patent
Urushihara et al.

(10) Patent No.: US 10,571,825 B1
(45) Date of Patent: Feb. 25, 2020

(54) ELECTROPHOTOGRAPHIC MEMBER, ELECTROPHOTOGRAPHIC PROCESS CARTRIDGE AND ELECTROPHOTOGRAPHIC IMAGE FORMING APPARATUS

(71) Applicant: CANON KABUSHIKI KAISHA, Tokyo (JP)

(72) Inventors: Shohei Urushihara, Mishima (JP); Kazuaki Nagaoka, Susono (JP); Sosuke Yamaguchi, Chiba (JP); Ryo Sugiyama, Mishima (JP); Minoru Nakamura, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/524,794

(22) Filed: Jul. 29, 2019

(30) Foreign Application Priority Data

Jul. 31, 2018 (JP) ..... 2018-144376

(51) Int. Cl.
*G03G 15/08* (2006.01)
*G03G 15/02* (2006.01)

(52) U.S. Cl.
CPC ..... *G03G 15/0808* (2013.01); *G03G 15/0233* (2013.01); *G03G 15/0818* (2013.01)

(58) Field of Classification Search
None
See application file for complete search history.

(56) References Cited

U.S. PATENT DOCUMENTS

2015/0198904 A1* 7/2015 Kikuchi ..... G03G 15/0233 492/18

FOREIGN PATENT DOCUMENTS

| | | |
|---|---|---|
| EP | 1014212 | 6/2000 |
| JP | 2015-087767 A | 5/2015 |
| JP | 2016-164654 A | 9/2016 |
| JP | 2017-072831 A | 4/2017 |
| JP | 2017-215458 A | 12/2017 |

* cited by examiner

*Primary Examiner* — Victor Verbitsky
(74) *Attorney, Agent, or Firm* — Venable LLP

(57) ABSTRACT

The electrophotographic member comprises: an electroconductive substrate; and an electroconductive layer on or above the substrate, an outer surface of the electrophotographic member having electrically insulating first regions and an electroconductive second region, each of the first regions being adjacent to the second region, wherein assuming that a square region having a side length of 300 μm is put on an outer surface of the electrophotographic member, in the square regions, the first regions are included, and assuming that Voronoi tessellation is conducted with respect to the first regions in the square region to create Voronoi polygons, a coefficient of variation of S1/SV is from 0.10 to 1.00, where SV denotes a plane area of each of the Voronoi polygons, and S1 denotes a plane area of one of the first regions included in each of the Voronoi polygons.

14 Claims, 6 Drawing Sheets

ELECTROPHOTOGRAPHIC MEMBER, ELECTROPHOTOGRAPHIC PROCESS CARTRIDGE AND ELECTROPHOTOGRAPHIC IMAGE FORMING APPARATUS

BACKGROUND

The present disclosure relates to an electrophotographic member, an electrophotographic process cartridge, and an electrophotographic image forming apparatus.

DESCRIPTION OF THE RELATED ART

As an image forming method using an electrophotographic image forming apparatus such as a copying machine or a laser beam printer, a developing method using nonmagnetic one-component toner is known. Specifically, a photosensitive member, which is a rotatable electrostatic latent image carrying member, is electrically charged using a charging unit such as a charging roller, and the surface of the charged photosensitive member is exposed to a laser beam to form an electrostatic latent image. Next, in the developing device of the image forming apparatus, the toner in the developer container is applied onto the developing roller by a developer regulating member, and development of the electrostatic latent image by the toner is performed at the contact portion between the photosensitive member and the developing roller. Thereafter, the toner image on the photosensitive member is transferred onto a recording material via the intermediate transfer member at the transfer portion or directly, the toner image is fixed onto the recording material by heat and pressure in the fixing unit, and the recording material having the fixed image is discharged out of the image forming apparatus.

In such an image forming method, the developing device includes the following electrophotographic members.

(1) A developer supply roller which exists in the developer container and supplies toner to the developing roller (2) A developer regulating member which forms a toner layer on the developing roller and adjusts the amount of toner on the developing roller to a fixed amount (3) A developing roller which closes the opening of the developer container for storing toner, exposes a part of the toner to the outside of the container, and disposes this exposed part to face the photosensitive member, and develops the toner on the photosensitive member In the developing device, an image is formed as these electrophotographic members rotate and rub.

In recent years, developing devices are demanded to have further increased speed, image quality, and durability. In order to increase the speed of developing devices, it is required to increase the rotational speed of developing roller. However, when the rotational speed of developing roller is increased, the abutting time required to supply the toner from the developer supply roller to the developing roller is shortened. For this reason, sufficient time for imparting electrically chargeable property to the toner by friction is not attained. As a result, there is a problem that the toner conveying force formed on the developing roller is insufficient and a uniform image is not attained. In addition, with regard to an increase in durability, there is a problem that the electric charge amount of the toner layer to be formed on the developing roller is likely to be insufficient during printing of an image.

In order to improve the toner conveying force of the developing roller, Japanese Patent Application Laid-Open No. 2016-164654 discloses a developing roller in which a regular dielectric portion having a certain size is provided on the surface and the toner is electrically attracted onto the charged dielectric portion to secure the toner conveying force and suppress fogging due to an insufficient electric charge amount.

SUMMARY

An aspect of the present disclosure is directed to providing an electrophotographic member which can be used as a developing member exhibiting excellent properties of electrically charging the toner as well as excellent toner conveying force.

Another aspect of the present disclosure is directed to providing an electrophotographic process cartridge which can provide a high quality electrophotographic image even in the case of being applied to a high-speed electrophotographic image forming process.

Furthermore, another aspect of the present disclosure is directed to providing an electrophotographic image forming apparatus with which a high quality electrophotographic image can be stably formed even in a case in which the electrophotographic image forming apparatus works at a high process speed.

According to an aspect of the disclosure, there is provided an electrophotographic member comprising: an electroconductive substrate; and an electroconductive layer on or above the substrate, an outer surface of the electrophotographic member having electrically insulating first regions and an electroconductive second region, each of the first regions being adjacent to the second region, wherein assuming that a square region having a side length of 300 μm is put on an outer surface of the electrophotographic member, the first regions are included in the square region, and assuming that Voronoi tessellation is conducted with respect to the first regions in the square region to create a plurality of Voronoi polygons each of which includes one of the first regions, a coefficient of variation of S1/SV is from 0.10 to 1.00, where SV denotes a plane area of each of the Voronoi polygons, and S1 denotes a plane area of one of the first regions included in each of the Voronoi polygons.

In addition, according to another aspect of the present disclosure, there is provided an electrophotographic process cartridge configured to be detachably attachable to an electrophotographic image forming apparatus, which includes at least a developing roller and in which the developing roller is the electrophotographic member described above.

In addition, according to still another aspect of the present disclosure, there is provided an electrophotographic image forming apparatus which includes a developing roller and in which the developing roller is the electrophotographic member described above.

Further features of the present disclosure will become apparent from the following description of exemplary embodiments with reference to the attached drawings.

DESCRIPTION OF THE EMBODIMENTS

Figure 1A:
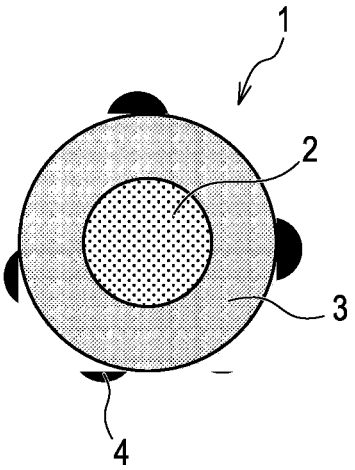
FIGS. 1A and 1B are schematic cross-sectional diagrams which illustrate an example of an electrophotographic member according to the present disclosure.

According to the investigations by the present inventors, in a case in which the developing roller according to Japanese Patent Application Laid-Open No. 2016-164654 is applied, for example, to an electrophotographic image forming apparatus having a faster process speed, the occurrence of "fogging" on the electrophotographic image and a decrease in density of the electrophotographic image which are caused by an insufficient electric charge amount of toner are recognized in some cases. The present inventors presume that the reason is as follows.

The impartment of electric charges to the toner by the developing member is performed by the frictional force generated between the developing member and the toner.

However, the dielectric portion of the developing roller according to Japanese Patent Application Laid-Open No. 2016-164654 hardly contributes to the impartment of electric charges to the toner. The results of investigations that the friction with the toner at the electroconductive portion controls the amount of frictional electric charge of the toner have been attained. Meanwhile, like the developing roller according to Japanese Patent Application Laid-Open No. 2016-164654, in an electrophotographic member having a dielectric portion and an electroconductive portion on the surface, an electric field is generated between the dielectric portion and the electroconductive portion as the dielectric portion is electrically charged and the toner is attracted and conveyed by coulomb force or gradient force. Moreover, the toner attracting force is greater as the size and number of the dielectric portions are greater. For this reason, the ability of imparting electric charges to the toner decreases when the size or number of dielectric portions is increased in order to attain a great conveying force.

Hence, it is considered that the occurrence of "fogging" on the electrophotographic image and a decrease in density of the electrophotographic image recognized in the case of using the developing roller according to Japanese Patent Application Laid-Open No. 2016-164654 are cause by the breakdown of the balance between the ability of the developing roller to convey the toner and the ability of the developing roller to impart electric charges to the toner.

Hence, as a result of intensive investigations, the present inventors have found that the electrophotographic member having the following configuration exhibits excellent ability of conveying toner and high ability of imparting electric charges to toner even when being used as a developing member in an electrophotographic image forming apparatus which works at a high process speed.

In other words, the electrophotographic member according to the present disclosure includes an electroconductive substrate and an electroconductive layer on or above the substrate. The surface of the electrophotographic member is configured to have mutually independent electrically insulating first regions and an electroconductive second region.

Each of the first regions are adjacent to the second region. When, a square region having a side length of 300 μm is put on an outer surface of the electrophotographic member, a plurality of the first regions are included in the square region.

Furthermore, assuming that Voronoi tessellation is conducted with respect to the first regions in the square region to create a plurality of Voronoi polygons each of which includes one of the first regions, a coefficient of variation of S1/SV is from 0.10 to 1.00, where SV denotes a plane area of each of the Voronoi polygons, and S1 denotes a plane area of each of the first regions included in each of the Voronoi polygons.

First, Volonoi tessellation with respect to the first regions to crate Voronoi polygons will be explained.

Voronoi polygons are polygons formed by Voronoi tessellation. Specifically, Voronoi tessellation is conducted according to the following procedure.

For example, when there are target regions in a certain field of vision, all independently adjacent regions are connected to each other by a straight line, and a perpendicular bisector is created for each of the straight lines connecting two adjacent regions. A region in which one region is surrounded by the perpendicular bisector is generated when the perpendicular bisectors extending from adjacent straight lines are connected to each other. The outer circumference of this region surrounded by the perpendicular bisector becomes a polygon, and this polygon is called a Voronoi polygon. The target regions correspond to the first regions and the certain field of vision correspond to the square region in the present disclosure.

The tessellation method includes tessellation based on the center of gravity of the region and tessellation based on the edge of the region. In the present disclosure, tessellation based on the edge is adopted. In tessellation based on the edge, the straight line which has the shortest distance among the straight lines connecting the respective edge portions of two adjacent first regions is selected, and a polygon formed by being surrounded by a perpendicular bisector with respect to this straight line is a Voronoi polygon. The size (plane area SV) of the Voronoi polygon indicates the distance between the adjacent first regions.

Here, the plane area of a Voronoi polygon refers to the minimum value of the projection area when the Voronoi polygon is projected with respect to the plane of a square region having a side length of 300 μm, which is an observation region of the outer surface of the electrophotographic member.

Figure 6:
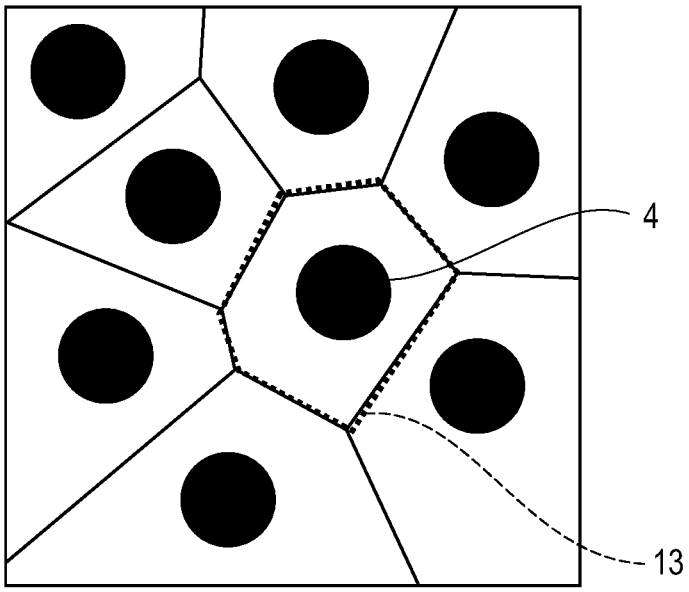
FIG. 6 is a diagram which illustrates an example of a Voronoi polygon defined in the present disclosure.

An example of a Voronoi polygon is described using FIG. 6. A region surrounded by a broken line with respect to a first region 4 is defined as a Voronoi polygon 13.

The magnitude of S1/SV is an index indicating the region in which the gradient force around each first region works, where SV denotes the plane area of a Voronoi polygon and S1 denotes the plane area of the first region included in the Voronoi polygon. In other words, as S1/SV is greater, the relative size of the first region is larger in the Voronoi polygon region and the gradient force works more strongly, and thus it is easy to attract the surrounding toner and the toner conveying force increases. On the other hand, the toner tends to hardly move and it is thus difficult to electrically charge the toner by friction. In addition, as S1/SV is smaller, the relative size of the first region in the Voronoi polygon region is smaller and the gradient force hardly works, and the toner is thus likely to roll and to be electrically charged by friction. On the other hand, the toner conveying force decreases. In the present disclosure, the relationship S1/SV between the first region and the Voronoi polygon including the first region is all calculated in a square region having a side length of 300 μm, and the arithmetic mean value thereof is denoted as (S1/SV)ave and the standard deviation thereof is denoted as (S1/SV)σ. In this case, a value attained by dividing (S1/SV)σ by (S1/SV)ave is defined as a coefficient of variation.

The coefficient of variation of S1/SV is from 0.10 to 1.00 and preferably 0.25 to 1.00. In addition, in the present disclosure, the arithmetic mean value of S1/SV is preferably from 0.05 to 0.60.

It is possible to indicate the distribution of the distance between the first regions by defining the coefficient of variation of S1/SV. In other words, the fact that the coefficient of variation is great means that the distribution of the first regions is sparse. By suitably selecting this range, the electrophotographic member can achieve both the properties of imparting electric charges to the toner and the toner conveying force.

<Electrophotographic Member>

An electrophotographic member is a member such as a developer carrying member, a transfer member, a charging member, a cleaning blade, or a developer layer thickness regulating member. Specific examples thereof include a developing roller, a transfer roller, an electroconductive roller such as a charging roller, a cleaning blade, and a developing blade. Hereinafter, the electrophotographic member according to the present disclosure will be described using a developing roller as a representative example if necessary, but the present disclosure is not limited to this.

The electrophotographic member can be applied to any of a non-contact type developing device or a contact type developing device using a magnetic one-component developer or nonmagnetic one-component developer, or a developing device using a two-component developer.

[Electroconductive Substrate]

The substrate is electroconductive and has a function of supporting an electroconductive layer to be provided thereon. Examples of the material therefor include metals such as iron, copper, aluminum, and nickel; and alloys such as stainless steel, duralumin, brass, bronze, and free-cutting steel containing these metals. The surface of the electroconductive substrate can be plated with chromium and nickel as long as the electroconductivity is not impaired. Furthermore, as the electroconductive substrate, a resin substrate of which the surface is covered with a metal so that the surface is electroconductive and one produced from an electroconductive resin composition can also be used. A known adhesive agent may be appropriately applied to the surface of the electroconductive substrate for the purpose of improving the adhesive property to the multilayer provided on the outer circumferential surface thereof.

[Electroconductive Layer]

The electroconductive layer has a single-layer structure or a multi-layered structure composed of stacked two or more layers. Particularly in a nonmagnetic one-component contact development system process, an electrophotographic member having two electroconductive layers is suitably used as a developing roller.

The electroconductive layer contains a resin and an elastic material such as rubber. Specific examples of the resin and rubber include the following. In other words, there are a polyurethane resin, a polyamide, a urea resin, a polyimide, a melamine resin, a fluororesin, a phenol resin, an alkyd resin, a silicone resin, polyester, ethylene-propylene-diene copolymer rubber (EPDM), acrylonitrile-butadiene rubber (NBR), chloroprene rubber (CR), natural rubber (NR), isoprene rubber (IR), styrene-butadiene rubber (SBR), fluororubber, silicone rubber, epichlorohydrin rubber, a hydride of NBR, urethane rubber and the like. Among these, in the case of having a layered structure, silicone rubber is preferable as the lower layer. Examples of silicone rubber include polydimethylsiloxane, polymethyltrifluoropropylsiloxane, polymethylvinylsiloxane, polyphenylvinylsiloxane, and copolymers of these siloxanes. These resins and rubber can be used singly or in combination of two or more kinds thereof if necessary. In addition, as the outermost layer, a polyurethane resin is preferable since the polyurethane resin exhibits excellent performance of electrically charging the toner by friction and excellent flexibility, thus is likely to attain a contact opportunity with the toner, and also exhibits wear resistance. Incidentally, the materials for the resin and rubber can be identified by measuring the electroconductive layer using a Fourier transform infrared visible spectrophotometer.

Examples of the polyurethane resin include an ether-based polyurethane resin, an ester-based polyurethane resin, an acrylic polyurethane resin, and a carbonate-based polyurethane resin. Among these, a polyether polyurethane resin is preferable since a negative charge is likely to be imparted to the toner by friction thereof with the toner and flexibility is likely to be attained.

The polyether polyurethane resin can be obtained by the reaction of a known polyether polyol with an isocyanate compound. Examples of the polyether polyol include polyethylene glycol, polypropylene glycol, and polytetramethylene glycol. In addition, these polyol components may be, if necessary, formed into a prepolymer prepared by subjecting these polyol components to chain extension by an isocyanate such as 2,4-tolylene diisocyanate, 2,6-tolylene diisocyanate (TDI), diphenylmethane diisocyanate (MDI), or isophorone diisocyanate (IPDI) in advance.

The isocyanate compound to react with these polyol components is not particularly limited, and examples thereof include the following. In other words, there are aliphatic polyisocyanates such as ethylene diisocyanate and 1,6-hexamethylene diisocyanate (HDI); alicyclic polyisocyanates such as isophorone diisocyanate (IPDI), cyclohexane 1,3-diisocyanate, and cyclohexane 1,4-diisocyanate; aromatic polyisocyanates such as 2,4-tolylene diisocyanate, 2,6-tolylene diisocyanate (TDI), and diphenylmethane diisocyanate (MDI); modified products and copolymers of these, and block bodies thereof.

It is preferable that the electroconductive layer contains an electroconductive agent in order to attain electroconductivity. Examples of the electroconductive agent include an ion conductive agent and an electron conductive agent such as carbon black. Carbon black is preferable since carbon black can control the electroconductivity of the electroconductive layer and the performance of the electroconductive layer to electrically charge the toner. Specific examples of the carbon black include conductive carbon blacks such as "Ketjen black" (trade name, manufactured by Lion Corporation) and acetylene black; and carbon blacks for rubber such as SAF, ISAF, HAF, FEF, GPF, SRF, FT, and MT. In addition, carbon black for color ink subjected to an oxidation treatment and pyrolytic carbon black can be used.

The amount of carbon black added is preferably 5 parts by mass or more and 50 parts by mass or less with respect to 100 parts by mass of the resin or rubber. The content of carbon black in the electroconductive layer can be measured using a thermogravimetric analyzer (TGA).

In addition to carbon black, examples of usable electroconductive agents include the following: Graphite such as natural graphite and artificial graphite; metal powders such as copper, nickel, iron, and aluminum; metal oxide powders such as titanium oxide, zinc oxide, and tin oxide; and electroconductive polymers such as polyaniline, polypyrrole, and polyacetylene. These can be used singly or in combination of two or more kinds thereof, if necessary.

The electroconductive layer can further contain a charge control agent, a lubricant, a filler, an antioxidant, an antiaging agent and the like as long as the functions of the resin or rubber and electroconductive agent are not inhibited.

The thickness of the electroconductive layer is preferably 1 μm or more and 5 mm or less. The thickness of the electroconductive layer can be determined by observing and measuring the cross section of the electroconductive layer using an optical microscope.

In a case in which the electrophotographic member is required to have a surface roughness when being used as a developing roller, fine particles for roughness control can be contained in the electroconductive layer. The volume average particle diameter of the fine particles for roughness control is preferably 3 μm or more and 20 μm or less. In addition, the amount of the fine particles contained in the electroconductive layer is preferably 1 part by mass or more and 50 parts by mass or less with respect to 100 parts by mass of the resin or rubber.

As the fine particles for roughness control, fine particles of a polyurethane resin, a polyester resin, a polyether resin, a polyamide resin, an acrylic resin, a polycarbonate resin and the like can be used.

[Confirmation of First Region and Second Region]

It can be confirmed that the first region and the second region are present by first observing the presence of two or more regions on the outer surface of the electrophotographic member using an optical microscope, a scanning electron microscope and the like.

Furthermore, it can be confirmed that the first region is electrically insulating and that the second region is more highly electroconductive than the first region by electrically charging the outer surface of the electrophotographic member including the first region and the second region and then measuring the residual potential distribution. The residual potential distribution can be confirmed by, for example, sufficiently electrically charging the outer surface of the electrophotographic member using a charging device such as a corona discharge device and then measuring the residual potential distribution on the electrically charged outer surface of the electrophotographic member using an electrostatic force microscope (EFM), a Kelvin probe force microscope (KFM) and the like.

In addition, the electrical insulating properties of the first region and the electroconductivity of the second region can also be evaluated by the potential damping time constant (hereinafter sometimes referred to as "time constant") of residual potential in addition to the volume resistivity. The time constant of residual potential is defined as the time required for damping the residual potential to 1/e of the initial value and is an index of the ease of retaining the electrically charged potential. Here, e is the base of natural logarithms.

It is preferable that the time constant of the first region is 60.0 seconds or more since the first region is electrically charged quickly and the potential by the electrical charging is likely to be retained. In addition, it is preferable that the time constant of the second region is less than 6.0 seconds since the electrical charging of the second region is suppressed, a potential difference is likely to be generated between the charged first region and the electroconductive layer, and the gradient force is likely to be expressed. Incidentally, in the measurement of the time constant in the present disclosure, in a case in which the residual potential is approximately 0 V at the time point of the start of measurement in the following measurement method, namely, in a case in which the potential is fully damped at the time point of the start of measurement, it is assumed that the time constant at the measurement point is less than 6.0 seconds. The time constant of residual potential can be determined by, for example, sufficiently electrically charging the outer surface of the electrophotographic member using a charging device such as a corona discharge device and then measuring the time courses of the residual potentials in the first region and second region on the electrically charged outer surface of the electrophotographic member using an electrostatic force microscope (EFM).

[Observation of Outer Surface of Electrophotographic Member]

An example of the observation of the outer surface of the electrophotographic member will be described below.

First, the outer surface of the electrophotographic member was observed using an optical microscope (VHX 5000 (product name) manufactured by Keyence Corporation), and it was confirmed that two or more regions were present on the outer surface. Subsequently, a thin section including the outer surface of the electrophotographic member was cut out from the electrophotographic member using a cryomicrotome (UC-6 (product name) manufactured by Leica Microsystems GmbH). The thin section was cut out so as to have a size of 50 μm×50 μm of the outer surface of the electrophotographic member at a temperature of −150° C. and a thickness of 1 μm based on the outer surface of the electroconductive layer and to include two or more regions on the outer surface of the electrophotographic member. Subsequently, the outer surface of the electrophotographic member on the cut thin section was observed under the optical microscope.

[Measurement of Residual Potential Distribution]

An example of the measurement of residual potential distribution will be described below.

The residual potential distribution was attained by electrically charging the outer surface of the electrophotographic member on the thin section using a corona discharge device and measuring the residual potential of the outer surface using a Kelvin probe force microscope (MFP-3D-Origin (product name) manufactured by Oxford Instruments plc) while scanning the thin section.

First, the thin section was placed on a smooth silicon wafer so that the surface including the outer surface of the electrophotographic member was on the upper surface, and left to stand for 24 hours in an environment having a temperature 23° C. and a relative humidity of 50%. Subsequently, in the same environment, the silicon wafer on which the thin section was placed was installed on a high-precision XY stage. As the corona discharge device, one in which the distance between the wire and the grid electrode was 8 mm was used. The corona discharge device was disposed at a position at which the distance between the grid electrode and the silicon wafer surface was 2 mm. Subsequently, the silicon wafer was grounded, and a voltage of −5 kV and a voltage of −0.5 kV were respectively applied to the wire and the grid electrode using an external power supply. After the start of application, the outer surface of the developing roller on the thin section was corona-charged by scanning the thin section parallel to the surface of the silicon wafer at a speed of 20 mm/sec so that the thin section passes immediately below the corona discharge device using the high-precision XY stage.

Subsequently, the thin section was set on the Kelvin probe force microscope in a direction in which the surface including the outer surface of the electrophotographic member on the thin section was the measurement surface, and the residual potential distribution was measured. The measurement conditions are presented below.

Measurement environment: temperature 23° C., relative humidity 50%;

Time until measurement starts after thin section has passed immediately below corona discharge device: 20 minutes;

Cantilever: OMCL-AC250TM manufactured by Olympus Corporation;

Gap between measurement surface and cantilever tip: 50 nm;

Measurement range: 50 μm×50 μm; and

Measurement interval: 200 nm×200 nm (50 μm/256).

It was checked whether each region was the electrically insulating first region or the second region more highly electroconductive than the first region by checking the presence or absence of residual potential in two or more regions present on the thin section from the residual potential distribution attained by the measurement. Specifically, the presence of the first region and second region was checked by taking a region including a place at which the absolute value of residual potential was less than 1 V as the second region and a region including a place at which the absolute value of residual potential was greater than the absolute value of the residual potential of the second region by 1 V or more as the first region among the two or more regions.

Incidentally, the method of measuring the residual potential distribution described above is an example, and the apparatus and conditions may be changed to those that are suitable for the check of presence or absence of the residual potential in the two or more regions depending on the size, interval, time constant and the like of the first region or electroconductive layer.

[Measurement of Time Constant of Residual Potential]

An example of the measurement of the time constant of the present residual potential will be described below.

The time constant of residual potential was determined by corona-charging the outer surface of the electrophotographic member using a corona discharge device, measuring the time course of the residual potential on the first region or the second region on the outer surface using an electrostatic force microscope (MODEL 1100TN manufactured by TREK JAPAN, INC.), and fitting the time course to the following Equation (1).

Here, the measurement point of the first region was a point at which the absolute value of residual potential was the greatest among the first regions confirmed by the measurement of residual potential distribution. In addition, the measurement point of the electroconductive layer was a point at which the residual potential was approximately 0 V among the second regions confirmed by the measurement of residual potential.

First, the thin section used in the measurement of residual potential distribution was placed on a smooth silicon wafer so that the surface including the outer surface of the electrophotographic member was the upper surface, and left to stand for 24 hours in an environment having a temperature 23° C. and a relative humidity of 50%.

Subsequently, in the same environment, the silicon wafer on which the thin section was placed was installed on the high-precision XY stage incorporated in the electrostatic force microscope. As the corona discharge device, one in which the distance between the wire and the grid electrode was 8 mm was used. The corona discharge device was disposed at a position at which the distance between the grid electrode and the silicon wafer surface was 2 mm. Subsequently, the silicon wafer was grounded, and a voltage of −5 kV and a voltage of −0.5 kV were respectively applied to the wire and the grid electrode using an external power supply. After the start of application, the thin section was corona-charged by scanning the thin section parallel to the surface of the silicon wafer at a speed of 20 mm/sec so that the thin section passes immediately below the corona discharge device using the high-precision XY stage.

Subsequently, using the high-precision XY stage, the measurement point of the first region or the second region was moved immediately below the cantilever of the electrostatic force microscope, and the time course of residual potential was measured. An electrostatic force microscope was used for the measurement. The measurement conditions are presented below.

Measurement environment: temperature 23° C., relative humidity 50%;

Time until measurement starts after measurement place has passed immediately below corona discharge device: 15 seconds;

Cantilever: Cantilever for Model 1100TN (Model No.: Model 1100TNC-N manufactured by TREK JAPAN, INC.);

Gap between measurement surface and cantilever tip: 10 μm;

Measurement frequency: 6.25 Hz; and

Measurement time: 1000 seconds.

The time constant τ was determined by fitting the time course of residual potential attained by the measurement to the following Equation (1) by the least squares method.

$$V0=V(t)\times\exp(-t/\tau) \quad (1)$$

t: Time elapsed after measurement place has passed immediately below corona discharge device (seconds)

V0: Initial potential (potential when t=0 seconds) (V)

V(t): Residual potential in t seconds after measurement place has passed immediately below corona discharge device (V)

τ: Time constant of residual potential (seconds).

The time constant τ of residual potential was measured at nine points of three points in the longitudinal direction and three points in the circumferential direction on the outer surface of the electrophotographic member in total, and the average value thereof was taken as the time constant of residual potential of the first region or the second region according to the present disclosure. Incidentally, in a case in which the measurement results included a point at which the residual potential was approximately 0 V at the time point of the start of measurement, namely, at the time point in 15 seconds after the corona charging was performed in the measurement of the electroconductive layer, the time constant was regarded as less than the average value of the time constants of the rest measurement points. In addition, in a case in which the potential at the time point of the start of measurement at all the measurement points was approximately 0 V, the time constant was regarded as less than the lower measurement limit.

[Martens Hardness of Second Region]

The Martens hardness of the second region is preferably from 0.10 N/mm$^2$ to 3.00 N/mm$^2$. By setting the Martens hardness to be in the above range, the electroconductive layer becomes properly soft, the contact opportunity between the developing roller and the toner increases, and the toner can be sufficiently electrically charged. In addition, rubbing of the toner with the first region is also effectively performed, thus the electric charge amount of the first region increases, and the toner conveying force can be sufficiently attained. When the Martens hardness is less than 0.10 $N/mm^2$, the electroconductive layer becomes too soft, the thickness of the toner layer increases, and the toner is not sufficiently electrically charged in some cases. In addition, when the Martens hardness exceeds 3.00 $N/mm^2$, the electroconductive layer becomes hard, the contact opportunity between the electrophotographic member and the toner decreases, and thus the toner is not sufficiently electrically charged in some cases.

[Method of Measuring Martens Hardness]

The measurement of the Martens hardness of the electroconductive second region is performed as follows using an electrophotographic member. As a measuring apparatus, PICODENTORHM 500 (trade name, manufactured by Fischer Measurement Technologies (India) Pvt. Ltd.) is used. A Vickers indenter is used as a measurement indenter. The developing roller is installed horizontally to the indenter, and the surface of the second region, which is the surface of the developing roller, is observed under a microscope. The observation conditions are set as follows: indenter penetration speed: 1 μm/sec, maximum indentation load: 0.1 mN, and indentation time: 20 seconds. The Martens hardness is represented by "maximum indentation load/26.43×indentation depth" and is calculated by detecting the "indentation depth". The same operation was performed at three places in total, and the arithmetic mean value of Martens hardness at the three points was determined. The arithmetic mean value of Martens hardness attained was taken as the Martens hardness of the first region.

[Electrically Insulating First Region]

Electrically insulating first regions are present in a part of regions on the surface of the electrophotographic member.

Examples of a material constituting the first region include a resin and a metal oxide, but a resin is preferable. Specific examples of the resin include the following. Examples thereof include an acrylic resin, a polyolefin resin, an epoxy resin, and a polyester resin. Among these, an acrylic resin is preferable. Specific examples of the acrylic resin include the following. Examples thereof include methyl methacrylate, 4-tert-butylcyclohexanol acrylate, stearyl acrylate, lauryl acrylate, 2-phenoxyethyl acrylate, isodecyl acrylate, isooctyl acrylate, isobornyl acrylate, 4-ethoxylated nonylphenol acrylate, and ethoxylated bisphenol A diacrylate.

Examples of a method of forming the first region on the electroconductive layer include various kinds of printing methods, but an electrospray method and a dipping method are preferable in order that first regions are present at a part of regions on the surface of the electroconductive layer.

[Area of First Region]

It is preferable that the average value (hereinafter also referred to as "plane area S1") of the areas of the parts at which first regions are in contact with the electroconductive layer is 1 $\mu m^2$ or more and 300 $\mu m^2$ or less. Here, the plane area of the first region refers to the smallest value among the projected areas when the first regions are projected onto the plane of a square region having a side length of 300 μm, which is an observation region on the outer surface of the electrophotographic member. By setting the plane area S1 to be in the above range, it is possible to sufficiently perform rubbing between the electrophotographic member and the toner as well as to properly adjust the toner conveying force by the electrophotographic member. In addition, this improves the toner conveying force of the electrophotographic member and also improves the properties of imparting frictional electric charges to the toner.

[Convex First Region]

Figure 1B:
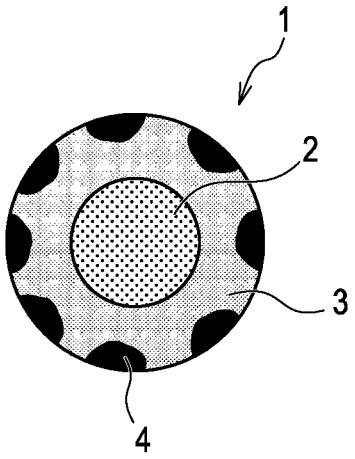
Figure 2:
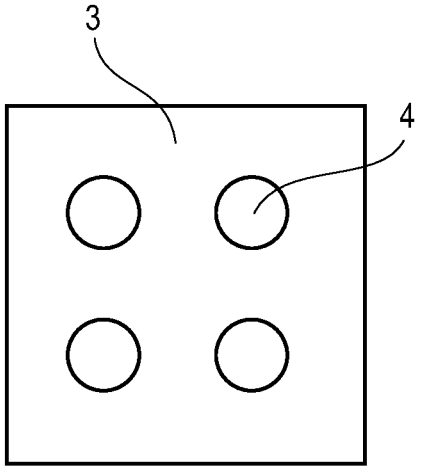
FIG. 2 is a schematic diagram which illustrates an example of the configuration of a surface of an electrophotographic member according to the present disclosure.

Here, referring to FIGS. 1A and 1B, FIG. 1A and FIG. 1B are examples which illustrate cross sections of the electrophotographic member according to the present disclosure in a direction orthogonal to the longitudinal direction. For example, as illustrated in FIG. 1A, the electrophotographic member is configured to include an electroconductive substrate 2, an electroconductive layer 3 on the substrate, and an insulating portion 4 on the outer surface of the electroconductive layer as an electrophotographic member 1. In this case, the insulating portion is located on the outer surface of the electroconductive layer on a side opposite to the side facing the substrate, the insulating portion forms a convex portion on the outer surface of the electrophotographic member. The insulating portion constitutes the first region. Further, a part of the outer surface of the electroconductive layer at which the insulating portion is not formed constitutes the second region. It is preferable that the average value of heights of convex portions of the insulating portions from the second region is from 0.3 μm to 5.0 μm. By setting the average value of the heights to 0.5 μm or more, the toner conveying force is likely to be attained. In addition, by setting the average value of the heights to 5.0 μm or less, rubbing between the electroconductive layer and the toner is likely to occur and the toner is likely to be electrically charged.

[Concave First Region]

In addition, as illustrated in FIG. 1B, the electrophotographic member may be configured so that the insulating portion 4 is present in the electroconductive layer and at least a part of the insulating portion 4 is exposed to the outer surface. In this case, the part exposed on the surface (not covered with the insulating portion 4) of the electroconductive layer 3 constitutes the second region. The surface of the insulating portion 4 constituting a part of the outer surface of the electrophotographic member constitutes the first region.

[Method of Measuring Plane Area of First Region and Method of Calculating (n/N)×100]

The plane area S1 of the first region is measured as follows.

An objective lens with a magnification of 20-fold is placed on a laser microscope (trade name: VK-X100 manufactured by Keyence Corporation), and the surface of the electrophotographic member is observed. Next, inclination correction of the observation image attained is performed. The inclination correction is performed in the quadric surface correction mode. The area of the first region included in the image is measured. The observation is performed at 10 points of the electrophotographic member, and the arithmetic mean value of the values attained is taken as the plane area S1 of the present disclosure. At this time, in the square area having a side length of 300 μm, the entire first regions which are completely included in this area are the target of measurement and the first regions which are not completely included are not the target of measurement.

(n/N)×100 is calculated where N denotes the number of first regions measured and n denotes the number of first regions of which the plane area S1 is in a range of from 1 $\mu m^2$ to 300 $\mu m^2$.

Moreover, in the present disclosure, it is preferable that (n/N)×100 is 90 or more.

[Method of Measuring Average Value of Height of Convex Portion in First Region]

The height of the convex portion in the first region is measured as follows. An objective lens with a magnification of 20-fold is placed on a laser microscope (trade name: VK-8700 manufactured by Keyence Corporation), and the surface of the electrophotographic member is observed. Next, inclination correction of the observation image attained is performed. The inclination correction is performed in the quadric surface correction mode. The difference "H2−H1" between the highest point H2 of the first region and the highest point height H1 of the second region is calculated using the three-dimensional observation image attained. At ten places of the electrophotographic member (one place per each region of ten regions attained by dividing the electrophotographic member into ten equal parts in the longitudinal direction), the interior of the square area having a side length of 300 μm at each place is observed, "H2−H1" is measured in each first region, and the arithmetic mean value of the "H2−H1" attained is taken as the average value Hm of the heights of the first regions of the present disclosure. At this time, in the square area having a side length of 300 μm, the entire first regions which are completely included in this area are the target of measurement and the first regions which are not completely included are not the target of measurement.

[Method of Forming First Region]

The method of forming the first region is not particularly limited, and examples thereof include a dip coating method, a spray coating method, and an electrospray method.

Incidentally, the electrospray method will be described in detail below. The electrospray method is a coating method in which the solution extruded from a syringe is electrically charged and scattered in the electric field by applying a high voltage between the material solution contained in the syringe and the collector electrode, becomes fine droplets by electrostatic repulsion, and are attached to the collector. This electrospray method has a feature that the coating position is easily controlled by appropriately selecting the ejecting conditions such as voltage and extrusion speed, and is preferable as a method of forming the first region of the present disclosure.

Figure 3:
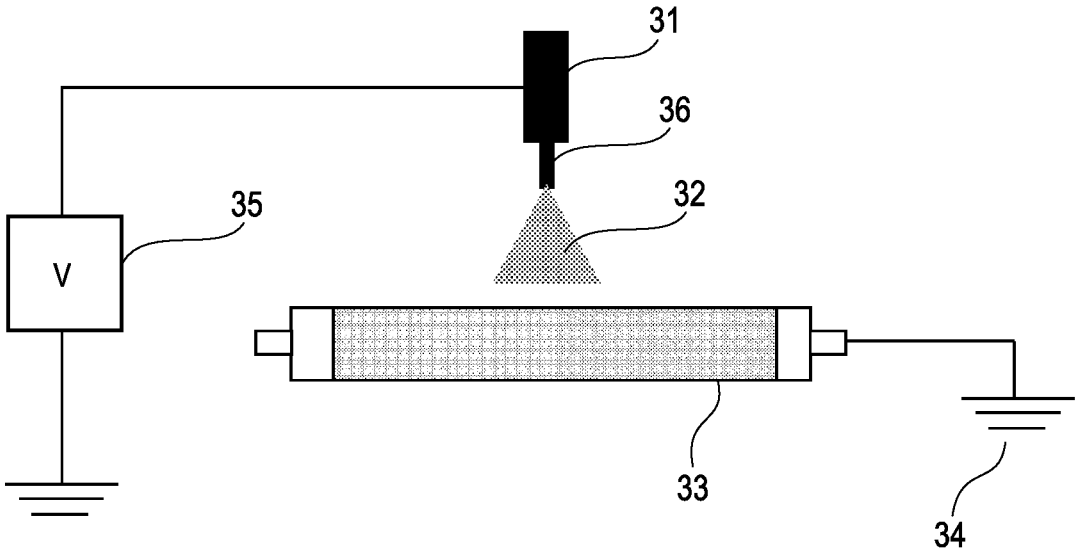
FIG. 3 is a schematic diagram of an electrospray apparatus for producing an electrophotographic member according to the present disclosure.

A schematic diagram of an electrospray apparatus, which is an example of an apparatus for producing the electrophotographic member, is illustrated in FIG. 3.

The method of fabricating the first region by the electrospray method will be described with reference to FIG. 3. The electrospray method is performed using a high-voltage power supply 35, a storage tank 31 of material solution, an ejecting port 36, and a collector 33 connected to a ground 34. The material solution is extruded from the storage tank 31 to the ejecting port 36 at a constant speed. A voltage of from 1 to 50 kV is applied to the ejecting port 36, a jet 32 of the material solution is emitted towards the collector 33 when the electrical attraction exceeds the surface tension of the material solution.

The method of preparing the material solution is not particularly limited, and conventionally known methods can be appropriately used. The kind of solvent and the concentration of solution are not particularly limited as long as the conditions are proper for the electrospray method. Moreover, not a material solution but a molten material heated to the melting point or more may be utilized.

<Electrophotographic Image Forming Apparatus>

Figure 4:
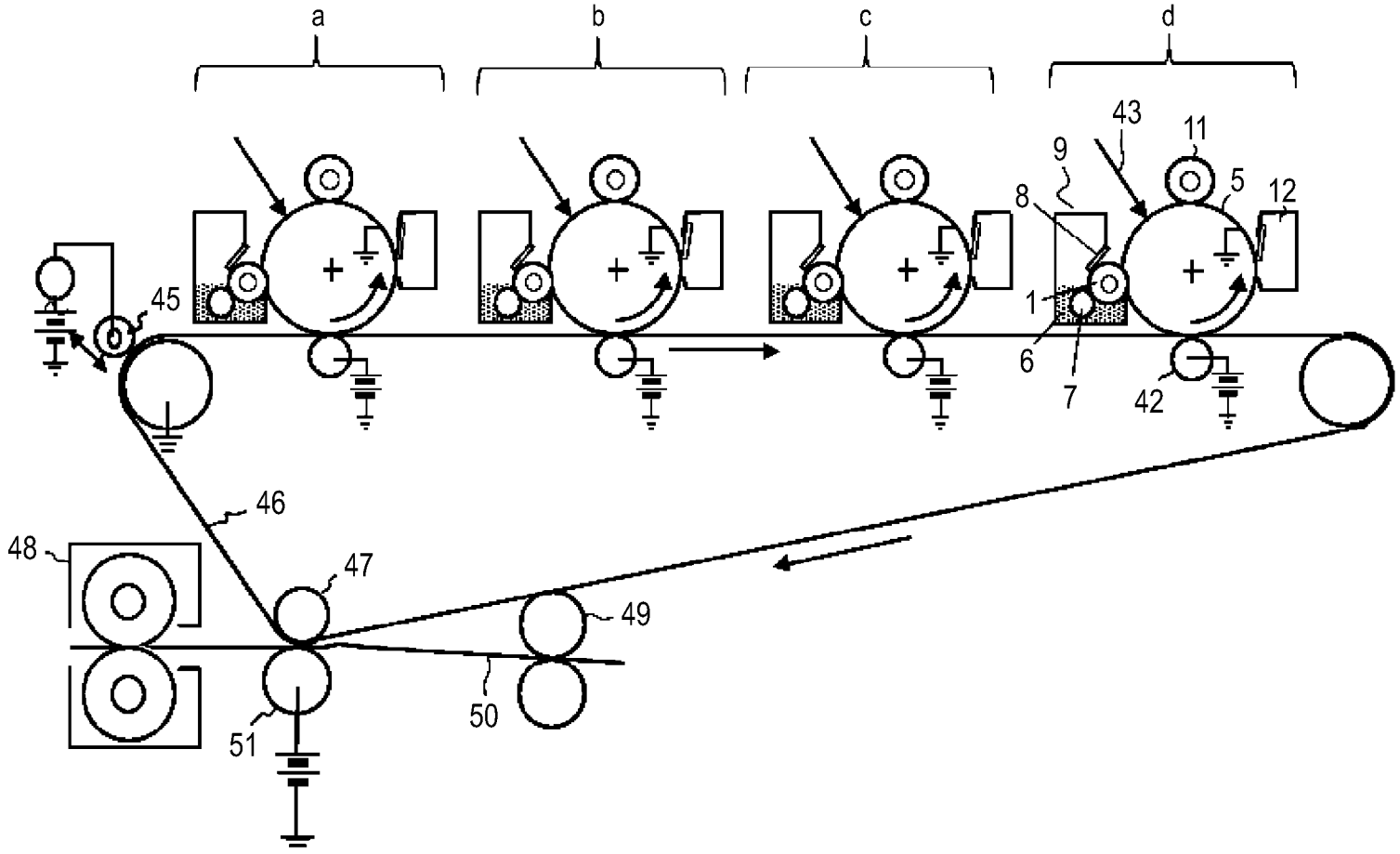
FIG. 4 is a schematic block diagram which illustrates an example of an electrophotographic image forming apparatus according to the present disclosure.

FIG. 4 is a cross-sectional diagram which illustrates an example of an electrophotographic apparatus using the electrophotographic member according to the present aspect as a developing roller. On the electrophotographic apparatus of FIG. 4, a developing device 9 including a developing roller 1, a toner supply roller 7, and a developing blade 8 is detachably mounted. The developing device 9 is prepared for the respective color toners of yellow (Y), magenta (M), cyan (C), and black (Bk), and enables color printing.

In addition, process cartridges (a) to (d) including an electrophotographic photosensitive member 5, a waste toner housing container 12, and a charging roller 11 are detachably mounted. In addition, the electrophotographic photosensitive member 5, the waste toner housing container, and the charging roller 11 may be disposed in the main body of the electrophotographic apparatus.

The electrophotographic photosensitive member 5 rotates in the direction of the arrow, and is evenly electrically charged by the charging roller 11 for electrically charging the electrophotographic photosensitive member 5. An electrostatic latent image is formed on the surface of the electrophotographic photosensitive member 5 by a laser beam 43 which is an exposure unit for writing the electrostatic latent image on the electrophotographic photosensitive member 5. The electrostatic latent image is developed by applying toner 6 thereto by the developing device 9 disposed to be in contact with the electrophotographic photosensitive member 5, and is visualized as a toner image.

As the development, so-called reversal development in which a toner image is formed on the exposed portion is performed. An intermediate transfer belt 46, which is an intermediate transfer member formed of an endless belt, as a second image carrying member for carrying the toner image is disposed so as to face the electrophotographic photosensitive member 5 of each process cartridge. The intermediate transfer belt 46 is stretched over a tension roller, a driving roller, and a secondary transfer counter roller 47 as stretching rollers and stretched at a predetermined tension. The intermediate transfer belt 46 rotates (performs circumferential movement) in the direction of the arrow in FIG. 4 at a circumferential velocity (process velocity) equal to the circumferential velocity of the electrophotographic photosensitive member 5 as the driving roller is rotationally driven. A primary transfer roller 42 as a primary transfer unit is disposed on the inner circumferential surface side of the intermediate transfer belt 46 to correspond to each electrophotographic photosensitive member 5. The primary transfer roller 42 is pressed toward the electrophotographic photosensitive member 5 via the intermediate transfer belt 46, and a primary transfer portion at which the electrophotographic photosensitive member 5 and the intermediate transfer belt 46 are in contact with each other is formed. The toner image formed on the electrophotographic photosensitive member 5 as described above is transferred (primary transfer) onto the rotating intermediate transfer belt 46 at the primary transfer portion. For example, when a full color image is formed, the toner images of the respective colors of yellow, magenta, cyan, and black formed on the respective electrophotographic photosensitive members 5 are sequentially transferred so as to be superimposed on the intermediate transfer belt 46.

A secondary transfer roller 51 as a secondary transfer unit is disposed at a position facing the secondary transfer counter roller 47 on the outer circumferential surface side of the intermediate transfer belt 46. The secondary transfer roller 51 is pressed toward the secondary transfer counter roller 47 via the intermediate transfer belt 46, and a secondary transfer portion at which the intermediate transfer belt 46 and the secondary transfer roller 51 are in contact with each other is formed. The toner image formed on the intermediate transfer belt 46 as described above is transferred (secondary transfer) to a recording material 50 such as paper which is nipped and conveyed by the intermediate transfer belt 46 and the secondary transfer roller 51 at the secondary transfer portion. This recording material 50 is supplied to the secondary transfer portion at the same timing as the toner image on the intermediate transfer belt 46 by a registration roller 49. The recording material 50 onto which the toner image has been transferred is conveyed to a fixing device 48 as a fixing unit, subjected to a fixing treatment by the fixing device 48, and discharged out of the apparatus, and the printing operation is completed. Meanwhile, the attached matters such as toner (residual toner after primary transfer) remaining on the electrophotographic photosensitive member 5 after the primary transfer step are scraped off by a cleaning blade, which is a cleaning member for cleaning the surface of the photosensitive member, and stored in the waste toner housing container. In addition, the attached matters such as toner (residual toner after secondary transfer) remaining on the intermediate transfer belt 46 after the secondary transfer step is removed from the intermediate transfer belt 46 and recovered by a belt cleaning device 45 as an intermediate transfer member cleaning unit.

The developing device 9 includes a developing device 9 housing toner 6 as a one-component developer, the electrophotographic photosensitive member 5 located at an opening portion extending in the longitudinal direction in the developing device 9, and a developing roller 1 as a developer carrying member installed to be resistant to light. This developing device 9 develops and visualizes the electrostatic latent image on the electrophotographic photosensitive member 5.

<Electrophotographic Process Cartridge>

Figure 5:
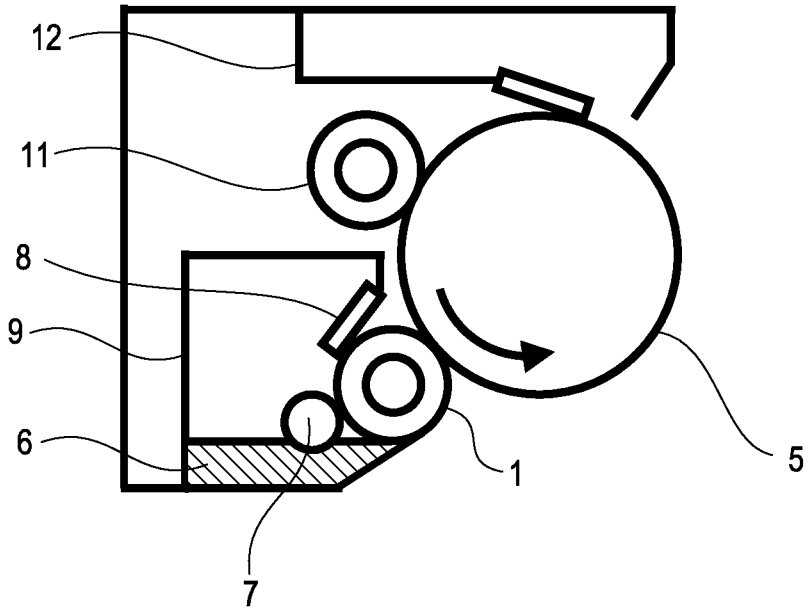
FIG. 5 is a schematic block diagram which illustrates an example of an electrophotographic process cartridge according to the present disclosure.

The electrophotographic process cartridge according to the present disclosure includes the electrophotographic member according to the present aspect as a developing roller, and is configured to be detachably attachable to the main body of the electrophotographic image forming apparatus. An example of the electrophotographic process cartridge of the present disclosure is illustrated in FIG. 5. The electrophotographic process cartridge illustrated in FIG. 5 includes a developing device 9, an electrophotographic photosensitive member 5, and a cleaning device 12, and these are integrated and detachably provided to the main body of the electrophotographic image forming apparatus. Examples of the developing device 9 include the same one as the image forming unit described in the electrophotographic image forming apparatus. The electrophotographic process cartridge of the present disclosure may be one in which a transfer member for transferring the toner image on the electrophotographic photosensitive member 5 to the recording material 50 and the like are integrally provided together with the above members in addition to the above.

In addition, in the electrophotographic process cartridge according to the present disclosure, only the developing device 9 may be configured to be detachably attachable.

According to an aspect of the present disclosure, it is possible to obtain an electrophotographic member which can be used as a developing member exhibiting excellent properties of imparting electric charges to the toner as well as excellent toner conveying force. In addition, according to another aspect of the present disclosure, it is possible to obtain an electrophotographic process cartridge which can provide a high quality electrophotographic image even in the case of being applied to a high-speed electrophotographic image forming process. Furthermore, according to another aspect of the present disclosure, it is possible to obtain an electrophotographic image forming apparatus with which a high quality electrophotographic image can be stably formed even in a case in which the electrophotographic image forming apparatus works at a high process speed.

EXAMPLES

Hereinafter, the present disclosure will be specifically described with reference to Production Examples and Examples, but the present disclosure is not limited to these.

[Production Example 1] Production of Electroconductive Elastic Roller 1

As an Electroconductive Substrate, One Obtained by Coating a Stainless Steel (SUS304) shaft core having an outer diameter of 6 mm and a length of 270 mm with a primer (trade name: DY35-051 manufactured by Dow Corning Toray Co., Ltd.) in a thickness of 10 μm, introducing the coated shaft core into a hot air vulcanization furnace at 150° C. for 15 minutes, and performing baking was prepared. This substrate was disposed in a mold, and an addition type silicone rubber composition prepared by mixing the materials presented in the following Table 1 together was injected into the cavity formed in the mold. Subsequently, the mold was heated, and the silicone rubber was cured by being heated at a temperature of 150° C. for 15 minutes, removed from the mold, and further heated at a temperature of 180° C. for 1 hour to complete the curing reaction, thereby producing an electroconductive elastic roller 1 having a 3 mm thick electroconductive layer on the outer circumference of the substrate.

TABLE 1

| Material | Parts by mass |
|---|---|
| Liquid silicone rubber material (trade name: SE6724A/B manufactured by Toray Dow Corning Toray Co., Ltd.) | 100 |
| Carbon black (trade name: TOKABLACK #7360SB manufactured by Tokai Carbon Co., Ltd.) | 20 |
| Platinum catalyst (trade name: SIP.6832.2 manufactured by GELEST, INC.) | 0.1 |

[Production Example 2] Production of Electroconductive Elastic Roller 2

An electroconductive substrate was obtained in the same manner as in Production Example 1. In addition, the materials presented in the following Table 2 were kneaded together to prepare an unvulcanized rubber composition. Next, a crosshead extruder having a substrate supplying mechanism and an unvulcanized rubber composition discharging mechanism was prepared. A die having an inner diameter of 12.1 mm was attached to the crosshead, the temperatures of the extruder and the crosshead were adjusted to 30° C., and the conveying speed of the substrate was adjusted to 60 mm/sec. Under this condition, the unvulcanized rubber composition was supplied from the extruder, and the unvulcanized rubber composition was covered as an elastic layer on the outer circumference of the substrate in the crosshead to obtain an unvulcanized rubber roller 2. Next, the unvulcanized rubber roller 2 was introduced into a hot air vulcanization furnace at 170° C., and the rubber was vulcanized by being heated for 15 minutes, thereby producing an electroconductive elastic roller 2 having a 3 mm thick electroconductive layer on the outer circumference of the substrate.

TABLE 2

| Material | Parts by mass |
|---|---|
| Millable silicone rubber material (trade name: TSE270-4U manufactured by Momentive Performance Materials Japan LLC) | 100 |
| Carbon black (trade name: TOKABLACK #7360SB manufactured by Tokai Carbon Co., Ltd.) | 15 |
| Curing agent (trade name: TC-8 manufactured by Momentive Performance Materials Japan LLC) | 0.5 |

[Production Example 3] Production of Electroconductive Elastic Roller 3

Two kinds of materials presented in the column of "Component 1" in the following Table 3 were added to and mixed with 200 parts by mass of methyl ethyl ketone (MEK). Subsequently, the mixture was reacted at a temperature of 80° C. for 4 hours under a nitrogen atmosphere to obtain a polyurethane polyol prepolymer. To 400 parts by mass of MEK, 100 parts by mass of this polyurethane polyol prepolymer and the other materials presented in the column of "Component 2" in the following Table 3 were added so that the total solid content became 30% by mass as a compounding ratio presented in Table 3, and these were stirred and dispersed in MEK using a ball mill to obtain a dispersion.

TABLE 3

| | Production Example | Production Example 3 | 8 | 9 | 10 | 11 | 12 | 13 | 14 | 15 |
|---|---|---|---|---|---|---|---|---|---|---|
| | Material | Added amount (parts by mass) | | | | | | | | |
| Component 1 | Polytetramethylene glycol (trade name: "PolyTHF" manufactured by BASF SE) | 100 | 100 | 100 | 100 | 100 | 100 | 100 | 100 | 100 |
| | Isocyanate (trade name: "MILLIONATE MT" (MDI) manufactured by Tosoh Corporation) | 18 | 18 | 18 | 18 | 18 | 18 | 18 | 18 | 18 |
| Component 2 | Polyurethane polyol prepolymer | 100 | 100 | 100 | 100 | 100 | 100 | 100 | 100 | 100 |
| | Isocyanate (trade name: "CORONATE T-80" manufactured by Tosoh Corporation) | 45 | 45 | 45 | 45 | 45 | 45 | 45 | 45 | 45 |
| | Acrylic resin (trade name: "HA3001" manufactured by Hitachi Chemical Co., Ltd.) | — | 1 | 3 | — | — | — | — | — | — |
| | Polyether-modified silicone oil (trade name: "TSF 4440" manufactured by TANAC Co., Ltd.) | — | — | — | 1 | 2 | — | — | — | — |
| | Acrylic resin particles (trade name: "MX-1500" manufactured by Soken Chemical and Engineering Co., Ltd.) | — | — | — | — | — | — | — | — | — |
| | Urethane resin particles (trade name: "C400 Transparent" Negami Chemical Industrial Co., Ltd.) | 13 | — | — | — | — | — | — | — | — |
| | Carbon black (trade name: "MA100" manufactured by Mitsubishi Chemical Corporation) | 36 | 36 | 36 | 36 | 36 | 15 | 50 | 5 | 60 |

In addition, an electroconductive elastic roller 3' was produced using an addition type silicone rubber composition and a mold in the same manner as in Production Example 1. Subsequently, the electroconductive elastic roller 3' was coated so as to have a film thickness of 10.0 μm using the dispersion as a coating liquid by a dipping method. In the dipping method, the upper end portion of the substrate was gripped and dipped in the coating liquid by taking the longitudinal direction of the electroconductive elastic roller 3' as the vertical direction. The dipping time was 9 seconds, the pulling up speed from the coating liquid was 30 mm/s as the initial speed and 20 mm/s as the final speed, and the speed was linearly changed with respect to the time between these. The coated product obtained was dried in an oven at a temperature of 80° C. for 15 minutes, and then subjected to the curing reaction in an oven at a temperature of 140° C. for 2 hours, thereby producing an electroconductive elastic roller 3. The electroconductive layer of the electroconductive elastic roller 3 has a layered structure composed of two layers.

[Production Example 4] Production of Electroconductive Elastic Roller 4

Three kinds of materials presented in the following Table 4 were added to 465 parts by mass of MEK so that the total solid content became 25% by mass, and stirred and dispersed in MEK using a ball mill to obtain a dispersion. Subsequently, an electroconductive elastic roller 4 was produced in the same manner as in Production Example 3 except that the film thickness at the time of coating was set to 4.0 μm.

TABLE 4

| Material | Parts by mass |
|---|---|
| Poly (tetramethylene ether/3-methyltetramethylene ether) glycol (trade name: "PTG-L3000" manufactured by Hodogaya Chemical Co., Ltd.) | 100 |
| Isocyanate (HDI manufactured by Tosoh Corporation) | 30 |
| Carbon black (trade name: "MA100" manufactured by Mitsubishi Chemical Corporation) | 33 |

[Production Example 5] Production of Electroconductive Elastic Roller 5

Three kinds of materials presented in the following Table 5 were added to 396 parts by mass of MEK so that the total solid content became 30% by mass, and stirred and dispersed in MEK using a ball mill to obtain a dispersion. Subsequently, an electroconductive elastic roller 5 was produced in the same manner as in Production Example 3.

TABLE 5

| Material | Parts by mass |
|---|---|
| Polyester polyol (trade name: "KURARAY P-3010" manufactured by KURARAY CO., LTD.) | 100 |
| Isocyanate (MDI manufactured by Tosoh Corporation) | 45 |
| Carbon black (trade name: "MA100" manufactured by Mitsubishi Chemical Corporation) | 36 |

[Production Example 6] Production of Electroconductive Elastic Roller 6

Three kinds of materials presented in the following Table 6 were added to 396 parts by mass of MEK so that the total solid content became 30% by mass, and stirred and dispersed in MEK using a ball mill to obtain a dispersion. Subsequently, an electroconductive elastic roller 6 was produced in the same manner as in Production Example 3.

TABLE 6

| Material | Parts by mass |
|---|---|
| Polycarbonate polyol (trade name: "KURARAY C-3010" manufactured by KURARAY CO., LTD.) | 100 |
| Isocyanate (MDI manufactured by Tosoh Corporation) | 41 |
| Carbon black (trade name: "MA100" manufactured by Mitsubishi Chemical Corporation) | 35 |

[Production Example 7] Production of Electroconductive Elastic Roller 7

Two kinds of materials presented in the following Table 7 were added to 680 parts by mass of MEK so that the total solid content became 15% by mass, and stirred and dispersed in MEK using a ball mill to obtain a dispersion. Subsequently, the dispersion was applied by the dipping method in the same manner as in Production Example 3 except that the film thickness at the time of coating was set to 3.0 μm. The coated product obtained was dried in an oven at a temperature of 100° C. for 15 minutes, thereby producing an electroconductive elastic roller 7.

TABLE 7

| Material | Parts by mass |
|---|---|
| Alcohol-soluble nylon (trade name: "FINE RESIN FR-101 manufactured by NAMARIICHI CO., LTD.) | 100 |
| Lithium trifluoromethanesulfonate (trade name: "EF-15" manufactured by MITSUBISHI MATERIALS ELECTRONIC CHEMICALS CO., LTD.) | 10 |

[Production Examples 8 to 15] Production of Electroconductive Elastic Rollers 8 to 15

Electroconductive elastic rollers 8 to 15 were produced in the same manner as in Production Example 3 except that the materials used in the preparation of dispersions were changed as presented in the column of "Component 2" in Table 3, respectively.

[Production Example 16] Production of Electroconductive Elastic Roller 16

Three kinds of materials presented in the following Table 8 were added to 336 parts by mass of MEK so that the total solid content became 30% by mass, and stirred and dispersed in MEK using a ball mill to obtain a dispersion. Subsequently, an electroconductive elastic roller 16 was produced in the same manner as in Production Example 3.

TABLE 8

| Material | Parts by mass |
|---|---|
| Polyester polyol (trade name: "KURARAY P-1010" manufactured by KURARAY CO., LTD.) | 100 |
| Isocyanate (MDI manufactured by Tosoh Corporation) | 15 |
| Carbon black (trade name: "MA100" manufactured by Mitsubishi Chemical Corporation) | 29 |

[Production Example 17] Production of Electroconductive Elastic Roller 17

Three kinds of materials presented in the following Table 9 were added to 315 parts by mass of MEK so that the total solid content became 30% by mass, and stirred and dispersed in MEK using a ball mill to obtain a dispersion. Subsequently, an electroconductive elastic roller 17 was produced in the same manner as in Production Example 3.

TABLE 9

| Material | Parts by mass |
|---|---|
| Polyester polyol (trade name: "KURARAY P-520" manufactured by KURARAY CO., LTD.) | 100 |
| Isocyanate (MDI manufactured by Tosoh Corporation) | 8 |
| Carbon black (trade name: "MA100" manufactured by Mitsubishi Chemical Corporation) | 27 |

[Production Example 18] Production of Raw Material 1 for First Region

A raw material 1 for the first region was obtained by mixing 15 parts by mass of ethoxylated bisphenol A diacrylate (trade name: A-BPE-4 manufactured by Shin Nakamura Chemical Co., Ltd.), 85 parts by mass of isobornyl acrylate (trade name: SR506NS manufactured by TOMOE Engineering Co., Ltd.), and 5 parts by mass of 1-hydroxycyclohexyl phenyl ketone (trade name: IRGACURE 184 manufactured by BASF SE) together.

[Production Examples 19 to 24] Production of Raw Materials 2 to 7 for First Region Raw materials 2 to 7 for the first region were obtained in the same manner as in Production Example 18 except that the kinds and amounts of the components used were changed as presented in Table 10. Incidentally, the numerical values of the respective components represent parts by mass in Table 10.

TABLE 10

| | Production Example | | | | | | |
|---|---|---|---|---|---|---|---|
| Production Example | 18 | 19 | 20 | 21 | 22 | 23 | 24 |
| Raw material No. | 1 | 2 | 3 | 4 | 5 | 6 | 7 |
| Ethoxylated bisphenol A diacrylate (trade name: A-BPE-4 manufactured by Shin Nakamura Chemical Co., Ltd.) | 15 | 30 | 50 | 5 | 80 | 90 | — |
| Isobornyl acrylate (trade name: SR506NS manufactured by TOMOE Engineering Co., Ltd.) | 85 | 70 | 50 | 95 | 0 | 0 | — |
| 1-Hydroxycyclohexyl phenyl ketone (trade name: IRGACURE 184 manufactured by BASF SE) | 5 | 5 | 5 | 5 | 5 | 5 | — |
| Amorphous polyester resin (trade name: VYLON 103 manufactured by TOYOBO CO., LTD.) | — | — | — | — | — | — | 20 |
| Methyl ethyl ketone | — | — | — | — | 20 | 10 | 80 |

Example 1

[Production of Electrophotographic Member 1]

The electroconductive elastic roller 3 was equipped as a collector of an electrospray apparatus (trade name: NANON manufactured by MEC Co., Ltd.). Next, the raw material 1 obtained in Production Example 18 was filled in the tank. Thereafter, the raw material 1 was ejected toward the electroconductive elastic roller 3 at 0.05 ml/min by moving the electrospray apparatus to the left and right at 50 mm/sec while applying a voltage of 8 kV to the ejecting port. At this time, the electroconductive elastic roller 3 as a collector was rotated at 1000 rpm. An electrophotographic member 1 in which an electrically insulating first region is present on the surface of an electroconductive elastic roller was obtained by ejecting the raw material 1 for 90 seconds.

Examples 2 to 6 and 9 to 24

[Production of Electrophotographic Members 2 to 6 and 9 to 24]

Electrophotographic members 2 to 6 and 9 to 24 were produced by the same method as that for the electrophotographic member 1 except that the kinds of the electroconductive elastic roller and the raw material for the first region were changed as presented in Table 11.

TABLE 11

| | Electro-conductive elastic roller No. | Raw material for first region No. |
|---|---|---|
| Electrophotographic member 1 | 3 | 2 |
| Electrophotographic member 2 | 7 | 2 |
| Electrophotographic member 3 | 5 | 2 |
| Electrophotographic member 4 | 6 | 2 |
| Electrophotographic member 5 | 2 | 2 |
| Electrophotographic member 6 | 3 | 7 |
| Electrophotographic member 9 | 4 | 2 |
| Electrophotographic member 10 | 8 | 2 |
| Electrophotographic member 11 | 10 | 2 |
| Electrophotographic member 12 | 9 | 2 |
| Electrophotographic member 13 | 11 | 2 |
| Electrophotographic member 14 | 17 | 2 |
| Electrophotographic member 15 | 1 | 2 |
| Electrophotographic member 16 | 16 | 2 |
| Electrophotographic member 17 | 13 | 1 |
| Electrophotographic member 18 | 12 | 5 |
| Electrophotographic member 19 | 15 | 4 |
| Electrophotographic member 20 | 14 | 6 |
| Electrophotographic member 21 | 3 | 3 |
| Electrophotographic member 22 | 3 | 1 |
| Electrophotographic member 23 | 3 | 5 |
| Electrophotographic member 24 | 3 | 6 |
| Electrophotographic member 25 | 3 | 2 |
| Electrophotographic member 26 | 3 | 2 |
| Electrophotographic member 27 | 3 | 2 |
| Electrophotographic member 28 | 3 | 2 |
| Electrophotographic member 29 | 3 | 2 |
| Electrophotographic member 30 | 3 | 2 |
| Electrophotographic member 31 | 3 | 2 |
| Electrophotographic member 32 | 3 | 2 |
| Electrophotographic member 33 | 3 | 2 |
| Electrophotographic member 34 | 3 | 2 |
| Electrophotographic member C1 | 3 | 2 |
| Electrophotographic member C2 | 3 | 2 |

Examples 7 and 8

[Production of Electrophotographic Members 7 and 8]

Rollers were produced in the same manner as in Production Example 3 except that the materials for the dispersions to be applied to the electroconductive elastic roller 3' were changed as presented in the column of "Component 2" in Table 12, respectively. Both end portions of the roller obtained were clamped and rotated at the number of revolutions of 500 rpm. In this state, a wrapping film sheet #15000 (trade name: A3-0.3SHT manufactured by 3M Company) which was an alumina abrasive film which had a particle size of 0.3 μm and was adjusted to a size of 5 cm in length and 25 cm in width was brought into contact with the roller at a pressing pressure of 10 N in the longitudinal direction, and polishing was performed by a method in which the polishing film descended from the upper part to the lower part of the roller at a speed of 30 mm/sec. This polishing step was repeated 100 times, thereby obtaining electrophotographic members 7 and 8.

TABLE 12

| | Material | Example 7 Added amount (parts by mass) | Example 8 Added amount (parts by mass) |
|---|---|---|---|
| Component 1 | Polytetramethylene glycol (trade name: "PolyTHF" manufactured by BASF SE) | 100 | 100 |
| | Isocyanate (trade name: "MILLIONAIL MT" (MDI) manufactured by Tosoh Corporation) | 18 | 18 |
| Component 2 | Polyurethane polyol prepolymer | 100 | 100 |
| | Isocyanate (trade name: "CORONATE T-80" manufactured by Tosoh Corporation) | 45 | 45 |
| | Acrylic resin particles (trade name: "MX-1500" manufactured by Soken Chemical & Engineering Co., Ltd.) | 30 | — |
| | Urethane resin particles (trade name: "C400 Transparent" Negami Chemical Industrial Co., Ltd.) | — | 30 |
| | Carbon black (trade name: "MA100" manufactured by Mitsubishi Chemical Corporation) | 40 | 40 |

Examples 25 to 34

[Production of Electrophotographic Members 25 to 34]

Electrophotographic members 25 to 34 were produced by the same method as that for the electrophotographic member 1 except that the applied voltage, the ejected amount, and the ejected time were changed as presented in Table 13.

TABLE 13

| | Applied voltage [kV] | Ejected amount [ml/min] | Ejected time [sec] |
|---|---|---|---|
| Electrophotographic member 25 | 8 | 0.05 | 25 |
| Electrophotographic member 26 | 8 | 0.05 | 150 |
| Electrophotographic member 27 | 8 | 0.05 | 15 |
| Electrophotographic member 28 | 8 | 0.05 | 200 |
| Electrophotographic member 29 | 7 | 0.03 | 150 |
| Electrophotographic member 30 | 7 | 0.04 | 113 |
| Electrophotographic member 31 | 6 | 0.03 | 150 |
| Electrophotographic member 32 | 10 | 0.07 | 65 |
| Electrophotographic member 33 | 7 | 0.05 | 90 |
| Electrophotographic member 34 | 9 | 0.06 | 75 |
| Electrophotographic member C2 | 12 | 0.07 | 65 |

Comparative Example 1

[Production of Electrophotographic Member C1]

The raw material 2 for the first region obtained in Production Example 19 was adjusted to have a droplet volume of 15 pl and applied onto the circumferential surface of the electroconductive elastic roller 3 obtained in Production Example 3 using a piezoelectric inkjet head. The coating was performed so that the intervals of the first region in the circumferential direction and the longitudinal direction were each 75 while rotating the electroconductive elastic roller. Thereafter, the raw material for the first region was cured by being irradiated with ultraviolet light for 10 minutes so as to have a wavelength of 254 nm and an integrated light quantity of 1500 mJ/cm$^2$ using a low pressure mercury lamp, thereby producing an electrophotographic member C1.

Comparative Example 2

[Production of Electrophotographic Member C2]

An electrophotographic member C2 was produced by the same method as that for the electrophotographic member 1 except that the applied voltage, the ejected amount, and the ejected time were changed as presented in Table 13.

The electrophotographic members 1 to 34 and C1 and C2 obtained were subjected to the measurement of the arithmetic mean value and coefficient of variation of S1/SV, the area, height and time constant of S1 in accordance with the methods of the present disclosure. In addition, the Martens hardness and time constant of the electroconductive layer of S2 were measured. In addition, the measurement results are presented in Tables 14 and 15.

TABLE 14

| | S1/SV | | S1 | | | | S2 | |
|---|---|---|---|---|---|---|---|---|
| | Coefficient of variation | Arithmetic mean value | Area [μm$^2$] | n/N × 100 | Height [μm] | Time constant [seconds] | Martens hardness [N/mm$^2$] | Time constant [seconds] |
| Electrophotographic member 1 | 0.50 | 0.20 | 153 | 95 | 2.3 | 2.7 × 10$^4$ | 0.50 | Less than 6.0 |
| Electrophotographic member 2 | 0.48 | 0.19 | 159 | 91 | 2.2 | 2.7 × 10$^4$ | 0.90 | Less than 6.0 |
| Electrophotographic member 3 | 0.51 | 0.21 | 153 | 94 | 2.0 | 2.7 × 104 | 1.00 | Less than 6.0 |
| Electrophotographic member 4 | 0.52 | 0.23 | 153 | 96 | 2.0 | 2.7 × 104 | 2.50 | Less than 6.0 |
| Electrophotographic member 5 | 0.47 | 0.22 | 156 | 92 | 2.1 | 2.7 × 104 | 0.56 | Less than 6.0 |
| Electrophotographic member 6 | 0.50 | 0.20 | 154 | 92 | 2.0 | 2.2 × 10$^3$ | 0.50 | Less than 6.0 |

TABLE 14-continued

| | S1/SV | | S1 | | | | S2 | |
|---|---|---|---|---|---|---|---|---|
| | Coefficient of variation | Arithmetic mean value | Area [μm$^2$] | n/N × 100 | Height [μm] | Time constant [seconds] | Martens hardness [N/mm$^2$] | Time constant [seconds] |
| Electrophotographic member 7 | 0.52 | 0.20 | 152 | 93 | 0.0 | $4.7 \times 10^3$ | 0.50 | Less than 6.0 |
| Electrophotographic member 8 | 0.50 | 0.20 | 153 | 94 | 0.0 | $4.0 \times 10^4$ | 0.50 | Less than 6.0 |
| Electrophotographic member 9 | 0.50 | 0.20 | 157 | 95 | 2.2 | 2.7 × 104 | 0.10 | Less than 6.0 |
| Electrophotographic member 10 | 0.48 | 0.21 | 165 | 96 | 0.3 | $2.7 \times 10^4$ | 0.50 | Less than 6.0 |
| Electrophotographic member 11 | 0.53 | 0.21 | 153 | 93 | 5.2 | $2.7 \times 10^4$ | 0.50 | Less than 6.0 |
| Electrophotographic member 12 | 0.47 | 0.23 | 157 | 92 | 0.1 | $2.7 \times 10^4$ | 0.50 | Less than 6.0 |
| Electrophotographic member 13 | 0.55 | 0.23 | 158 | 94 | 6.0 | $2.7 \times 10^4$ | 0.50 | Less than 6.0 |
| Electrophotographic member 14 | 0.50 | 0.20 | 159 | 95 | 2.0 | $2.7 \times 10^4$ | 4.00 | Less than 6.0 |
| Electrophotographic member 15 | 0.50 | 0.20 | 153 | 96 | 2.0 | $2.7 \times 10^4$ | 0.09 | Less than 6.0 |
| Electrophotographic member 16 | 0.50 | 0.20 | 152 | 95 | 2.2 | $2.7 \times 10^4$ | 3.00 | Less than 6.0 |
| Electrophotographic member 17 | 0.52 | 0.19 | 153 | 96 | 2.1 | $8.5 \times 10^1$ | 0.50 | Less than 6.0 |
| Electrophotographic member 18 | 0.53 | 0.18 | 150 | 94 | 2.0 | $4.5 \times 10^6$ | 0.50 | Less than 6.0 |

TABLE 15

| | S1/SV | | S1 | | | | S2 | |
|---|---|---|---|---|---|---|---|---|
| | Coefficient of variation | Arithmetic mean value | Area [μm$^2$] | n/N × 100 | Height [μm] | Time constant [seconds] | Martens hardness [N/mm$^2$] | Time constant [seconds] |
| Electrophotographic member 19 | 0.48 | 0.20 | 153 | 93 | 2.1 | $5.9 \times 10^1$ | 0.50 | Less than 6.0 |
| Electrophotographic member 20 | 0.49 | 0.20 | 150 | 94 | 2.1 | $1.5 \times 10^6$ | 0.50 | Less than 6.0 |
| Electrophotographic member 21 | 0.50 | 0.20 | 290 | 64 | 2.0 | $3.0 \times 10^3$ | 0.50 | Less than 6.0 |
| Electrophotographic member 22 | 0.50 | 0.20 | 1.2 | 46 | 1.9 | $8.5 \times 10^1$ | 0.50 | Less than 6.0 |
| Electrophotographic member 23 | 0.50 | 0.20 | 350 | 46 | 2.0 | $4.5 \times 10^6$ | 0.50 | Less than 6.0 |
| Electrophotographic member 24 | 0.50 | 0.20 | 5023 | 3 | 2.1 | $1.5 \times 10^6$ | 0.50 | Less than 6.0 |
| Electrophotographic member 25 | 0.50 | 0.05 | 156 | 92 | 2.2 | $2.7 \times 10^4$ | 0.50 | Less than 6.0 |
| Electrophotographic member 26 | 0.50 | 0.60 | 153 | 91 | 2.3 | $2.7 \times 10^4$ | 0.50 | Less than 6.0 |
| Electrophotographic member 27 | 0.50 | 0.03 | 156 | 98 | 2.0 | $2.7 \times 10^4$ | 0.50 | Less than 6.0 |
| Electrophotographic member 28 | 0.50 | 0.65 | 154 | 92 | 2.5 | $2.7 \times 10^4$ | 0.50 | Less than 6.0 |
| Electrophotographic member 29 | 0.22 | 0.20 | 160 | 91 | 2.1 | $2.7 \times 10^4$ | 0.50 | Less than 6.0 |
| Electrophotographic member 30 | 0.26 | 0.20 | 162 | 90 | 2.3 | $2.7 \times 10^4$ | 0.50 | Less than 6.0 |
| Electrophotographic member 31 | 0.11 | 0.20 | 153 | 94 | 1.8 | $2.7 \times 10^4$ | 0.50 | Less than 6.0 |
| Electrophotographic member 32 | 0.99 | 0.20 | 153 | 95 | 1.9 | $2.7 \times 10^4$ | 0.50 | Less than 6.0 |
| Electrophotographic member 33 | 0.30 | 0.20 | 160 | 93 | 2.1 | $2.7 \times 10^4$ | 0.50 | Less than 6.0 |
| Electrophotographic member 34 | 0.70 | 0.20 | 154 | 94 | 2.0 | $2.7 \times 10^4$ | 0.50 | Less than 6.0 |
| Electrophotographic member Cl | 0.03 | 0.19 | 153 | 95 | 2.3 | $2.7 \times 10^4$ | 0.50 | Less than 6.0 |
| Electrophotographic member C2 | 1.13 | 0.19 | 150 | 93 | 2.0 | $2.7 \times 10^4$ | 0.50 | Less than 6.0 |

[Evaluation Using Electrophotographic Image Forming Apparatus]

The electrophotographic member 1 as a developing roller was mounted on the process cartridges for yellow, magenta, cyan, and black for an electrophotographic image forming apparatus (product name: Color Laser Jet Pro M652dw manufactured by HP Development Company, L.P.), incorporated in the electrophotographic image forming apparatus, and left to stand for 24 hours in a high temperature and high humidity environment having a temperature of 35° C. and a relative humidity of 85%.

[1. Evaluation on Amount of Toner Conveyed]

Next, the electrophotographic image forming apparatus was reconstructed so as to output an image at a speed of 80 sheets of A4 size paper/min in the same environment, and an image having a coverage rate of 0.2% was output 20,000 sheets. Thereafter, the output operation was stopped while outputting the first sheet of a solid black image at the same speed of 80 sheets of A4 size paper/min, the electrophotographic member 1 was taken out, and the amount of toner attached onto the electrophotographic member 1 (amount of toner conveyed) was measured. At this time, the measured region was the region between the electrophotographic photosensitive member abutting portion and the toner regulating member abutting portion when the output operation was stopped. In the measurement method, the toner was sucked using a suction nozzle having an opening with a diameter of 5 mm, the amount of toner sucked and the area of region sucked were measured, and the amount of toner conveyed (mg/cm$^2$) was determined.

[2. Evaluation on Electric Charge Amount of Toner and Fogging]

Next, after a white solid image was output five sheets at a speed of 80 sheets/min, the operation of the printer was stopped while outputting the first sheet of a white solid image. The toner was sucked from the toner layer formed on the electrophotographic member 1 using a suction nozzle having an opening with 5 mm ϕ, the electric charge amount of the sucked toner and the toner mass were measured, and the electric charge amount of toner (μC/g) was determined. The electric charge amount was measured using a digital electrometer (trade name: 8252 manufactured by ADC CORPORATION).

In addition, the toner attached onto the photosensitive member was peeled off using a transparent tape (trade name: POLYESTER TAPE No. 550 manufactured by NICHIBAN CO., LTD.) and stuck to white paper (trade name: Business Multipurpose 4200 manufactured by Xerox Corporation) to obtain a sample for evaluation. Next, the reflection density R1 of the sample for evaluation was measured using a reflection densitometer (TC-6DS/A manufactured by Tokyo Denshoku Co., LTD.). At this time, a green filter was used as the filter. Meanwhile, the reflection density R0 of a reference sample in which only the transparent tape was stuck to white paper was measured in the same manner. The amount of decrease in reflectivity "R0-R1" (%) of the sample for evaluation with respect to the reference sample was taken as the fogging value (%).

The physical property measurement and image evaluation were performed by the same method as in Example 1 except that the electrophotographic member 1 was changed to electrophotographic members 2 to 34 (Examples 2 to 34) and electrophotographic members C1 and C2 (Comparative Examples 1 and 2). The measurement results are presented in Table 16.

TABLE 16

| | | Amount of toner conveyed [mg/cm2] | Electric charge amount of toner [μC/g] | Fogging value [%] |
|---|---|---|---|---|
| Example 1 | Electrophotographic member 1 | 0.38 | 35 | 1.2 |
| Example 2 | Electrophotographic member 2 | 0.37 | 32 | 1.5 |
| Example 3 | Electrophotographic member 3 | 0.36 | 34 | 1.4 |
| Example 4 | Electrophotographic member 4 | 0.36 | 32 | 1.4 |
| Example 5 | Electrophotographic member 5 | 0.39 | 36 | 1.5 |
| Example 6 | Electrophotographic member 6 | 0.38 | 33 | 1.3 |
| Example 7 | Electrophotographic member 7 | 0.37 | 28 | 2.2 |
| Example 8 | Electrophotographic member 8 | 0.36 | 29 | 2.1 |
| Example 9 | Electrophotographic member 9 | 0.36 | 37 | 1.1 |
| Example 10 | Electrophotographic member 10 | 0.33 | 29 | 2.1 |
| Example 11 | Electrophotographic member 11 | 0.38 | 37 | 1.1 |
| Example 12 | Electrophotographic member 12 | 0.31 | 24 | 2.7 |
| Example 13 | Electrophotographic member 13 | 0.39 | 26 | 2.4 |
| Example 14 | Electrophotographic member 14 | 0.32 | 28 | 2.2 |
| Example 15 | Electrophotographic member 15 | 0.34 | 30 | 1.9 |
| Example 16 | Electrophotographic member 16 | 0.33 | 34 | 1.5 |
| Example 17 | Electrophotographic member 17 | 0.37 | 28 | 2.3 |
| Example 18 | Electrophotographic member 18 | 0.35 | 37 | 1.1 |
| Example 19 | Electrophotographic member 19 | 0.37 | 22 | 4.2 |
| Example 20 | Electrophotographic member 20 | 0.35 | 39 | 0.9 |
| Example 21 | Electrophotographic member 21 | 0.36 | 29 | 2.0 |
| Example 22 | Electrophotographic member 22 | 0.33 | 38 | 1.0 |
| Example 23 | Electrophotographic member 23 | 0.40 | 24 | 2.8 |
| Example 24 | Electrophotographic member 24 | 0.41 | 22 | 3.5 |
| Example 25 | Electrophotographic member 25 | 0.33 | 39 | 1.0 |
| Example 26 | Electrophotographic member 26 | 0.39 | 30 | 1.9 |
| Example 27 | Electrophotographic member 27 | 0.31 | 42 | 0.9 |
| Example 28 | Electrophotographic member 28 | 0.40 | 26 | 2.5 |
| Example 29 | Electrophotographic member 29 | 0.32 | 22 | 4.1 |
| Example 30 | Electrophotographic member 30 | 0.33 | 28 | 2.4 |
| Example 31 | Electrophotographic member 31 | 0.31 | 20 | 4.5 |
| Example 32 | Electrophotographic member 32 | 0.30 | 36 | 1.2 |
| Example 33 | Electrophotographic member 33 | 0.34 | 26 | 2.6 |
| Example 34 | Electrophotographic member 34 | 0.34 | 32 | 1.7 |
| Comparative Example 1 | Electrophotographic member C1 | 0.27 | 16 | 5.3 |
| Comparative Example 2 | Electrophotographic member C2 | 0.28 | 13 | 5.8 |

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-144376, filed Jul. 31, 2018, which is hereby incorporated by reference herein in its entirety.

What is claimed is:

1. An electrophotographic member comprising:

an electroconductive substrate; and an electroconductive layer on or above the substrate, an outer surface of the electrophotographic member having electrically insulating first regions and an electroconductive second region, each of the first regions being adjacent to the second region, wherein when a square region having a side length of 300 μm is put on an outer surface of the electrophotographic member, the first regions are included in the square region, and when Voronoi tessellation is conducted with respect to the first regions in the square region to create a plurality of Voronoi polygons each of which includes one of the first regions, a coefficient of variation of S1/SV is from 0.10 to 1.00, where SV denotes a plane area of each of the Voronoi polygons, and S1 denotes a plane area of each of the first regions included in each of the Voronoi polygons.

2. The electrophotographic member according to claim 1, wherein the coefficient of variation of S1/SV is from 0.25 to 1.00.

3. The electrophotographic member according to claim 1, wherein an arithmetic mean value of S1/SV is from 0.05 to 0.60.

4. The electrophotographic member according to claim 1, wherein (n/N)×100 is 90 or more, where N denotes a number of first regions in the square region and n denotes a number of first regions having a plane area S1 in a range of from 1 $\mu m^2$ to 300 $\mu m^2$ in the square region.

5. The electrophotographic member according to claim 1, wherein when the electrophotographic member is electrically charged so that a potential of a surface of each of the first regions constituting a part of an outer surface of the electrophotographic member is V0 (V), a potential damping time constant defined as time required for damping a surface potential to V0×(1/e) is 60.0 seconds or more and a potential damping time constant of the second region is less than 6.0 seconds.

6. The electrophotographic member according to claim 1, wherein a Martens hardness measured on a surface of the second region, the surface constituting the outer surface of the electrophotographic member, at a maximum indentation load of 0.1 mN is from 0.10 $N/mm^2$ to 3.00 $N/mm^2$.

7. The electrophotographic member according to claim 1, wherein the first regions are constituted by insulating portions on an outer surface of the electroconductive layer on a side opposite to a side facing the substrate, the insulating portions form convex portions on the outer surface of the electrophotographic member, and the second region is constituted by a part at which the insulating portions are not formed on the outer surface of the electroconductive layer.

8. The electrophotographic member according to claim 7, wherein an average value of heights of convex portions of the insulating portions from the second region is from 0.3 μm to 5.0 μm.

9. The electrophotographic member according to claim 7, wherein the insulating portion contains an acrylic resin.

10. The electrophotographic member according to claim 1, wherein the electroconductive layer has insulating portions at least a part of which are exposed to an outer surface of the electroconductive layer on a side opposite to a side facing the substrate, and exposed portions of the insulating portions constitute the first regions.

11. The electrophotographic member according to claim 10, wherein the insulating portion contains an acrylic resin.

12. The electrophotographic member according to claim 1, wherein the electroconductive layer contains a urethane resin and carbon black.

13. An electrophotographic process cartridge which is detachably attachable to an electrophotographic image forming apparatus, comprising at least a developing roller, wherein the developing roller includes an electroconductive substrate, an electroconductive layer on or above the substrate, an outer surface of the electrophotographic member having electrically insulating first regions and an electroconductive second region, each of the first regions being adjacent to the second region, wherein when a square region having a side length of 300 μm is put on an outer surface of the electrophotographic member, the first regions are included in the square region, and when Voronoi tessellation is conducted with respect to the first regions in the square region to create a plurality of Voronoi polygons each of which includes one of the first regions, a coefficient of variation of S1/SV is from 0.10 to 1.00, where SV denotes a plane area of each of the Voronoi polygons, and S1 denotes a plane area of one of the first regions included in each of the Voronoi polygons.

14. An electrophotographic image forming apparatus comprising a developing roller, wherein the developing roller includes an electroconductive substrate, an electroconductive layer on or above the substrate, an outer surface of the electrophotographic member having electrically insulating first regions and an electroconductive second region, each of the first regions being adjacent to the second region, wherein when a square region having a side length of 300 μm is put on an outer surface of the electrophotographic member, the first regions are included in the square region, and when Voronoi tessellation is conducted with respect to the first regions in the square region to create a plurality of Voronoi polygons each of which includes one of the first regions, a coefficient of variation of S1/SV is from 0.10 to 1.00, where SV denotes a plane area of each of the Voronoi polygons, and S1 denotes a plane area of one of the first regions included in each of the Voronoi polygons.

* * * * *